US008327832B2

(12) United States Patent
Henry

(10) Patent No.: US 8,327,832 B2
(45) Date of Patent: Dec. 11, 2012

(54) PAPER LAUNCHING APPARATUS AND METHODS

(76) Inventor: Lee L. Henry, Castle Rock, CO (US)

( * ) Notice: Subject to any disclaimer, the term of this patent is extended or adjusted under 35 U.S.C. 154(b) by 258 days.

(21) Appl. No.: 12/690,635

(22) Filed: Jan. 20, 2010

(65) Prior Publication Data

US 2011/0017184 A1 Jan. 27, 2011

Related U.S. Application Data

(60) Provisional application No. 61/146,199, filed on Jan. 21, 2009.

(51) Int. Cl.
*F41B 3/00* (2006.01)

(52) U.S. Cl. ..... 124/5

(58) Field of Classification Search ..... 124/5
See application file for complete search history.

(56) References Cited

U.S. PATENT DOCUMENTS

| | | | | |
|---|---|---|---|---|
| 3,901,208 | A * | 8/1975 | Laporte et al. | 124/5 |
| 4,076,004 | A * | 2/1978 | Huelskamp | 124/5 |
| 4,548,413 | A * | 10/1985 | David | 473/173 |
| 5,823,850 | A * | 10/1998 | Watkins | 446/475 |
| 6,076,829 | A | 6/2000 | Oblack | |
| 7,686,001 | B2 * | 3/2010 | Fitt | 124/5 |

OTHER PUBLICATIONS wikiHow "How to Toilet Paper a House" printed Jan. 14, 2009, http://www.wikihow.com/Tollet-Paper-a-House (6 pages).

* cited by examiner

*Primary Examiner* — John Ricci
(74) *Attorney, Agent, or Firm* — Swanson & Bratschun, L.L.C.

(57) ABSTRACT

Apparatus and methods for throwing or launching paper or other material. The apparatus may be configured engage with a roll of paper or other material, and/or to impart a spin on the roll of paper or other material upon release of the roll. This spin can cause the paper or other material to unroll as it is released from the apparatus.

19 Claims, 7 Drawing Sheets

PAPER LAUNCHING APPARATUS AND METHODS

CROSS-REFERENCE TO RELATED APPLICATIONS

This application claims the benefit, under 35 U.S.C. §119(e), of commonly-owned, provisional U.S. Patent App. Ser. No. 61/146,199, filed Jan. 21, 2009 by Lee L. Henry and entitled "Paper Launching Apparatus and Methods," the entire disclosure of which is incorporated herein by reference for all purposes.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to tools and techniques for throwing and/or launching objects and more particularly, to tools and techniques for throwing and/or launching paper and other materials.

BACKGROUND

Many people enjoy throwing rolls of paper and other objects for entertainment and decorative purposes. Merely by way of example, a roll of crepe paper, toilet paper, etc. may be thrown and/or draped over objects to decorate a venue for an event, to celebrate a success, and/or as a friendly prank. Such objects can include rafters, houses, cars, trees and many other objects. People also enjoy throwing rolls of paper that unravel in the air to create streamers at sporting events, parades, school functions, weddings, graduations and other various celebratory events. Unfortunately, the effort required to effectively throw a roll of paper without mechanical assistance can injure a person's arm, back or shoulder. Additionally some individuals do not have the strength to throw a roll of paper at distances. Further, if thrown without assistance, a roll of paper may fail to unravel properly, potentially causing property damage (from impact of the rolled paper) and/or frustration for the thrower.

BRIEF SUMMARY

In a certain aspect, some embodiment provide apparatus and methods to facilitate the launching of paper and/or other material, including in particular rolled paper or material. Various embodiments provide such an apparatus that is safe, easy to use, durable, and/or economical to fabricate.

One set of embodiments, for example, provides an apparatus for launching or throwing a material (e.g., paper). In an aspect of some embodiments, the paper may be arranged in a roll around a first longitudinal axis; the apparatus may have a second longitudinal axis. In one embodiment, the apparatus comprises a handle portion, a central shaft portion in mechanical communication with the handle portion, and/or a material-holding element in mechanical communication with the central shaft portion. In an aspect, the material-holding element may be configured to engage the roll of material.

In certain embodiments, the material-holding element engages the roll of material in order to hold the roll of material with the first longitudinal axis transverse to the second longitudinal axis. In other embodiments, the material-holding element is configured to release the roll of paper upon manipulation of the apparatus, such that the material-holding element imparts a spin upon the roll of paper material when releasing the roll of paper material. This spin can cause the roll of paper material to begin unroll upon release.

Another set of embodiments provides methods of unrolling, throwing and/or launching paper and/or a rolled material. An exemplary method comprises engaging a rolled material with a launching apparatus (or, more specifically, with a material-holding element of a launching apparatus). In an aspect, the launching apparatus might comprise a handle portion, a central shaft portion in mechanical communication with the handle portion, and/or a material-holding element in mechanical communication with the central shaft portion; the material-holding element might be configured to engage the roll of paper material. In accordance with some embodiments, the method further comprises moving the apparatus through a range of motion describing an arc and/or substantially stopping the movement of the apparatus, so as to cause the apparatus to release the rolled material in such a way to impart a spin on the rolled material. As noted above, this spin can cause the rolled material to begin to unroll upon release from the apparatus. In some cases, the rolled material is released in a direction to cause the material to drape over an object as it unrolls.

BRIEF DESCRIPTION OF THE DRAWINGS

A further understanding of the nature and advantages of particular embodiments may be realized by reference to the remaining portions of the specification and the drawings wherein like reference numerals are used throughout the several drawings to refer to similar components. In some instances, a sublabel is associated with a reference numeral to denote one of multiple similar components. When reference is made to a reference numeral without specification to an existing sublabel, it is intended to refer to all such multiple similar components.

DETAILED DESCRIPTION OF CERTAIN EMBODIMENTS

While various aspects and features of certain embodiments have been summarized above, the following detailed description illustrates a few exemplary embodiments in further detail to enable one of skill in the art to practice such embodiments. In the following description, for the purposes of explanation, numerous specific details are set forth in order to provide a thorough understanding of the described embodiments. It will be apparent, however, to one skilled in the art that other embodiments of the present invention may be practiced without some of these specific details. In other instances, well-known structures and devices are shown in block diagram form. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

One set of embodiments provides an apparatus for throwing a roll of paper or other material. In some aspects, the apparatus may be configured to cause the material to unroll while traveling through the air. Any of a variety of types of paper or other material may be used in accordance with various embodiments of the invention. Examples include, without limitation, crepe paper, segmented tissue paper (e.g., "toilet paper"), unsegmented tissue paper, and/or any other type of paper or material, including in particular any type of paper or material that can be spooled in a generally cylindrical shape about a roll having a longitudinal axis.

Figures 1, 2:
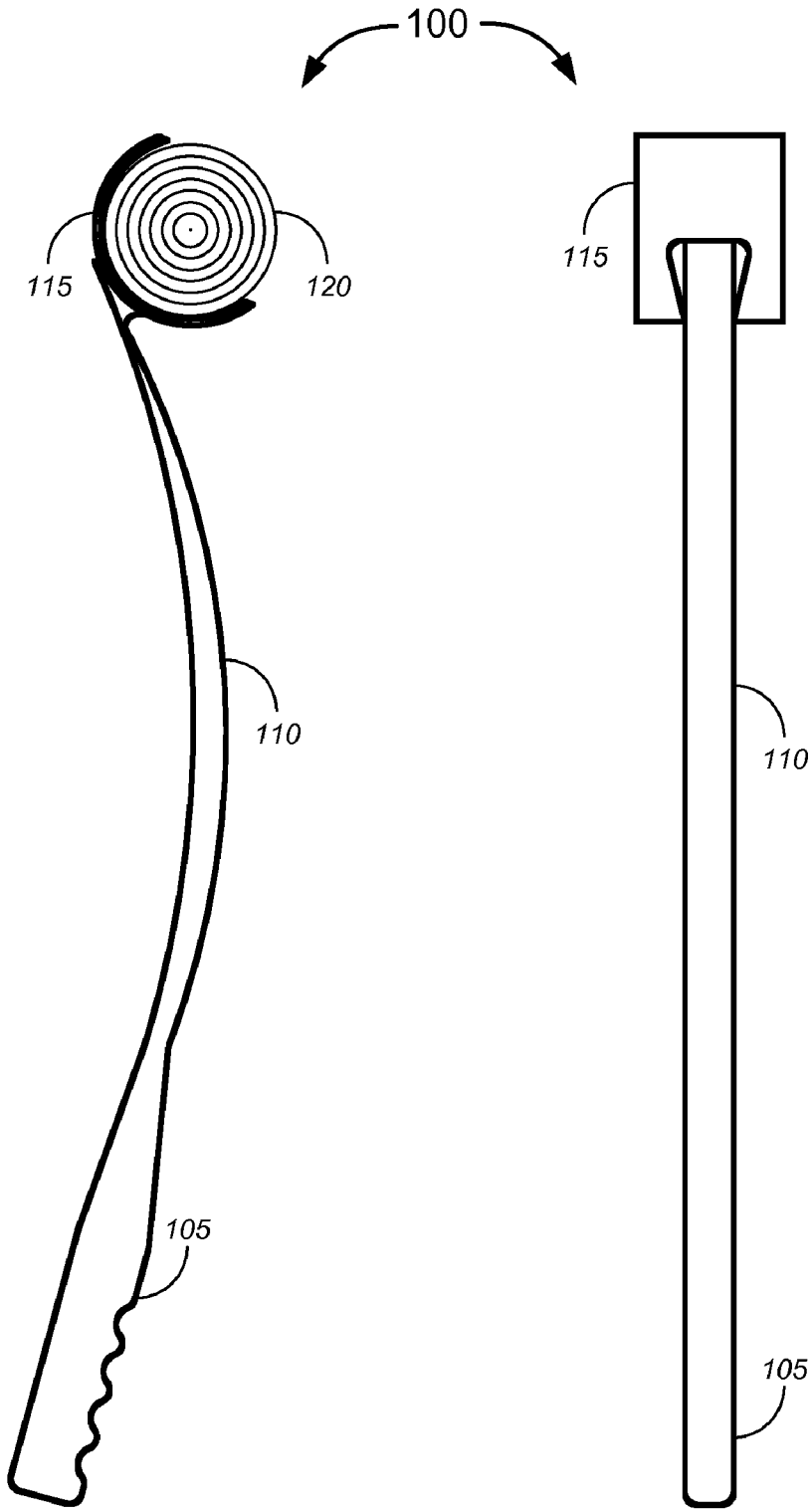
FIG. 1 is a side elevation view of a launching apparatus, in accordance with various embodiments.
FIG. 2 is a back elevation view of a launching apparatus, in accordance with various embodiments.

FIGS. 1 and 2 illustrate an apparatus (referred to herein as a "launching apparatus") for throwing and/or launching a roll of material in accordance with one set of embodiments. The launching apparatus comprises a handle portion 105, which is adapted to be held in the hand of a user, a central shaft portion 110, and a material-holding element 115. Each portion 105, 110, 115 may be formed separately and coupled using appropriate coupling devices (such as rivets or other fasteners, welding, chemical bonding, and/or the like). Alternatively and/or additionally, two or more portions may be integrally formed (e.g., through a molding process, extrusion process, etc.). In some cases, the handle portion 105, the central shaft portion 110, and the material-holding element 115 may be coaxial, so as to define a longitudinal axis of the apparatus 100. In other cases, (as illustrated), these portions may not be coaxial but instead may be aligned an oblique angle (and/or one or more portions, such as the central shaft portion 110, may be formed to describe an arc or an oblique angle), such that the portions 105, 110, 115 are substantially coplanar, thereby defining a longitudinal plane of the apparatus 100. In an aspect, the material-holding element 115 is located at an end of the apparatus 110 that is distal from a user, and the handle portion 105 is located at an end of the apparatus 100 that is proximal to the user.

Figure 4:
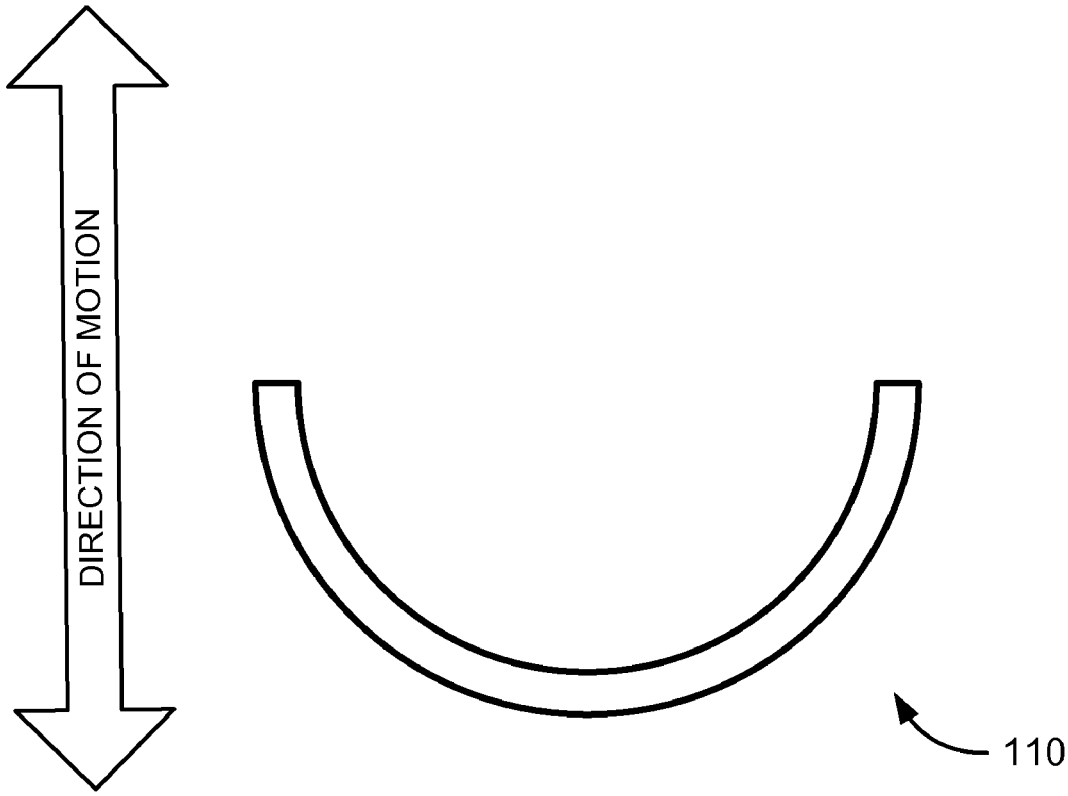
FIG. 4 is a cross-sectional view of a central shaft portion of a launching apparatus, in accordance with various embodiments.

Any of a variety of materials may be used to form the apparatus 100 (and/or the various portions thereof); such materials can include a variety of plastics, rubbers, and/or metals and metal alloys. The apparatus (and/or the various portions thereof) may be formed using a variety of processes, including without limitation molding, extrusion, forging, and/or the like. In an embodiment, the apparatus 100 is formed from a material with sufficient strength to resist breakage, sufficient elasticity to allow the apparatus to generate a whip-like force when moved (as described below), and/or sufficient rigidity to maintain structural integrity when subjected to the angular acceleration of such motion. In addition, the apparatus 100 and/or portions thereof, may be formed in a manner to accentuate these characteristics. Merely by way of example, the central shaft portion 110, which is subject to a bending force as a result of the angular acceleration generated by a typical movement of the apparatus, may be formed in a generally semi-tubular shape with an semi-annular cross-section as illustrated by FIG. 4; the open portion of the semi-annular cross section might be coincident with the direction of movement of the apparatus 100 when used in the intended manner; this configuration may accentuate the structural rigidity of the central shaft 110

In one embodiment, the overall length of the apparatus 100 is between 12 and 60 inches, and more particularly, between 24 and 48 inches. In a particular aspect, the overall length of the apparatus might fall between approximately 30 and 42 inches, or between 32 and 40 inches. The width of the apparatus is discretionary, although in many embodiments, the circumference of the handle portion 105 is designed to provide a comfortable and secure grip for an average-sized human hand, perhaps between approximately 3 and 4 inches in circumference. The central shaft portion 110 may be designed with a cross-sectional width that provides sufficient (but not excessive) flexibility to allow the material-holding portion 115 to undergo a whip-like effect during operation and that also provides for durability. This width generally will vary depending on the construction materials, but in certain embodiments, the width can fall between approximately half an inch and two inches, or more particularly between approximately three quarters of an inch and one-and-one-half inches. The cross sectional width of the material-holding element 115 generally will be sufficient to hold at least a substantial portion of the material to be launched and thus generally will depend on the intended use of the apparatus. Merely by way of example, for a toilet-paper roll launcher, the width of the material-holding element 115 might be between approximately three-and-a-half and five inches, while for a streamer launcher, the width might fall between approximately one inch and three inches. In some cases, the width of the material-holding element 115 might be sufficient to hold two (or more rolls) of the material end-to-end. Alternatively and/or additionally, the apparatus 100 might feature two (or more) material-holding elements 115 each configured to hold one (or more) rolls of material; this plurality of material-holding elements 115 might be situated so as to hold two or more rolls of material substantially end-to-end, i.e., so that the longitudinal axes of each roll are substantially coaxial.

Figure 3:
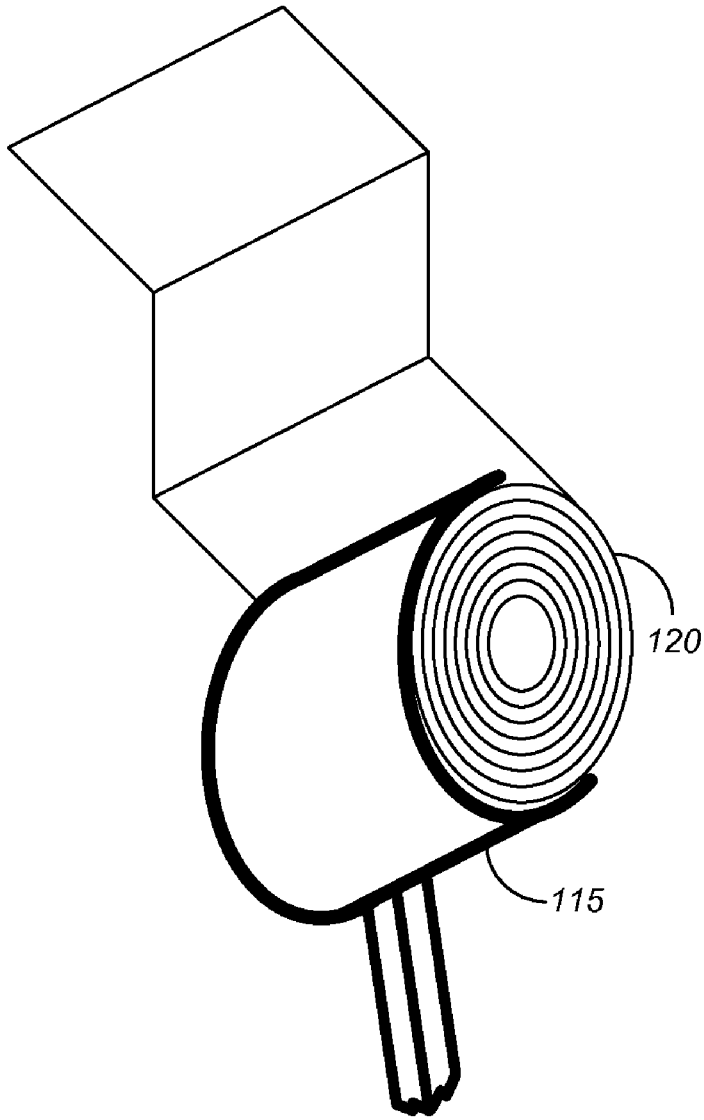
FIG. 3 is a detail drawing illustrating a material-holding element of a launching apparatus, in accordance with various embodiments.

As illustrated in further detail by FIG. 3, the material-holding element 115 is configured to hold a roll of material 120. (In many cases, the material may be a type of paper, but in some cases, other materials may be used as well.) Typically, the material 120 will be situated in the material-holding element 115, so that a longitudinal axis of the roll (around which the material is centrally wrapped to generally form a cylinder) is transverse to the longitudinal axis of (and/or the plane formed by) the handle portion 105 and the central shaft portion 110 of the apparatus 100, as shown by FIGS. 1 and 2. In some embodiments, the material-holding element 115 is shaped and/or sized so as to compress the material 120 sufficiently to hold the material 120 during movement of the apparatus, but not to compress the material 120 sufficiently to force the material 120 to remain within the material-holding element 115 when this motion is abruptly stopped.

In one aspect, the material-holding element is sized to accept a particular type and/or size of material roll (such as a toilet paper roll, a crepe paper roll, a streamer roll, and/or the like). In another aspect, the material-holding element 115 may be coupled with the central shaft portion using a detachable coupling mechanism (such as a frictional coupling, a slot-and-tab coupling, a set of one or more bolts, etc.), such that differently-sized and/or differently-configured material-holding elements 115 may be substituted.

Figure 5A:
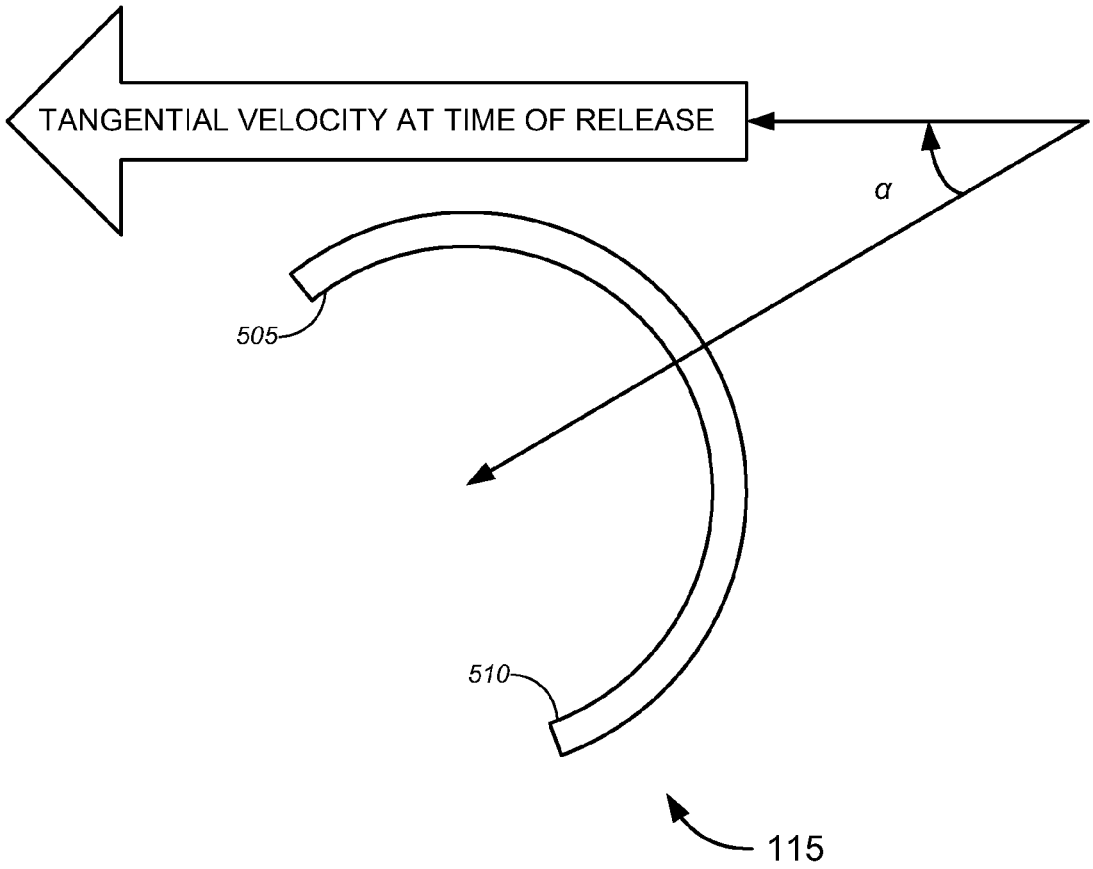
FIG. 5A is cross-sectional view of a material-holding element of a launching apparatus, in accordance with various embodiments.
Figure 6:
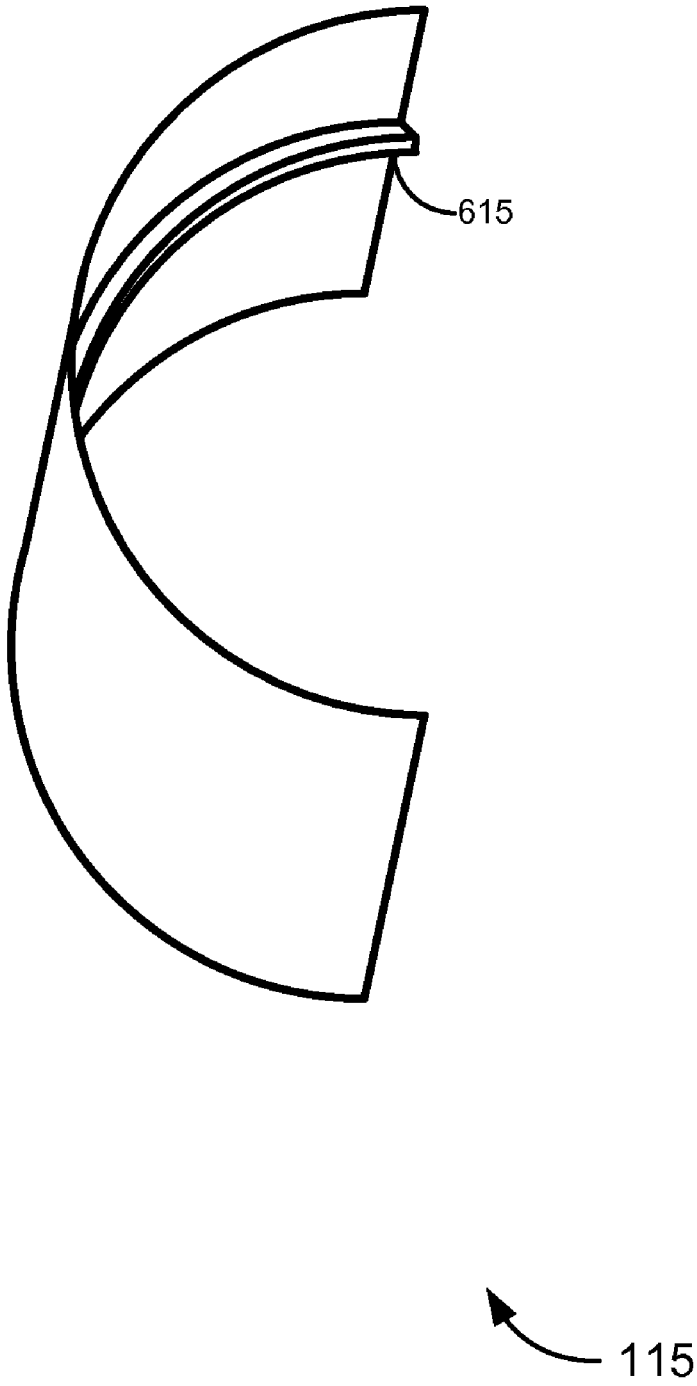
FIG. 6 a photograph showing a detailed view of a material-holding element of a launching apparatus, in accordance with various embodiments.

In some cases, the apparatus 100 is configured to cause a roll of material to unroll when launched by the apparatus 100. Merely by way of example, the material-holding element 115 of the apparatus 100 may be shaped, adapted and/or positioned in such a way as to impart rotation or spin (e.g., sidespin, backspin and/or topspin) on a roll of paper that is engaged by the material-holding element 115 (with the longitudinal axis of the material roll 120 transverse to the longitudinal axis of the apparatus 120). In a particular aspect, the material-holding element 115 may be shaped, adapted, and/or positioned so as to cause the roll to rotate about the longitudinal axis of the roll. In some cases, the material-holding element 115 describes a portion of a tube, as depicted in FIGS. 3, 5A and 6. The material-holding element 115 may be configured such that the open portion of the tube is situated so as to impart spin on the roll of material 120 as the material exits the material-holding element. One such configuration is illustrated by FIG. 5A, in which the open portion of the material-holding element 115 is aligned at an angle $\alpha$ with the tangential velocity vector at the time the material 120 is released from the apparatus 100. This angle $\alpha$ may be selected so as to cause one portion 505 of the material-holding element 115 to exert more frictional force on the material 120 than another portion 510 at the time of release, thereby causing the roll of material 120 to spin as it leaves the material-holding element. 115. This spin will cause the material 120 to unroll as it flies through the air.

Figure 5B:
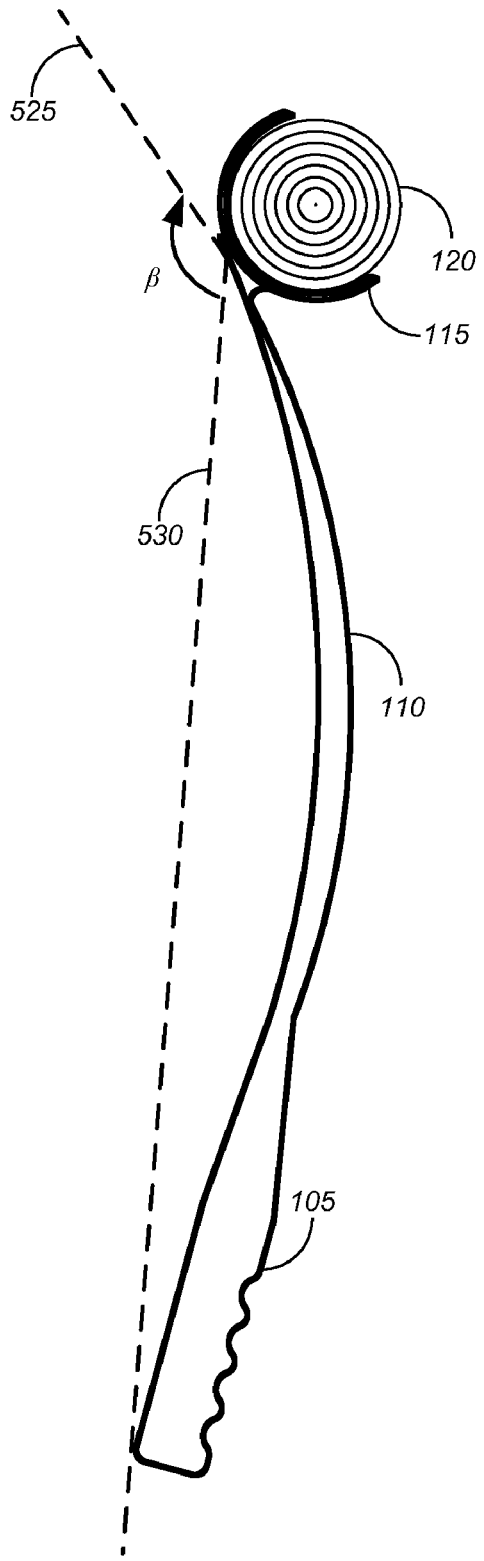
FIG. 5B is a cross-sectional view of a launching apparatus illustrating an angle between a material-holding element and an apparatus body.

As illustrated by FIG. 5B, which is a cross-sectional view of a launching apparatus 100, this principle may be implemented in practice by controlling an angle $\beta$ between the open face of the material-holding element 115 (as expressed by a line generally parallel to a chord between the two endpoints of the closed portion of the material-holding element, which corresponds to a line 525 tangential to a central point on the closed portion of the material-holding element 115, when viewed as a cross section, as in FIG. 5B) and the longitudinal axis of the launching apparatus 100, which can be viewed as a line 530 between a handle portion of the apparatus 100 and the point at which the central shaft portion 110 meets the material-holding element 115. In an embodiment, the apparatus 100 may be manufactured to provide a desired value of $\beta$, while in other embodiments, the apparatus 100 may be designed to allow a user to adjust the angle $\beta$. For example, the apparatus (or at least a portion thereof, such as the central portion 110) may comprise a material that, under certain circumstances (such as heating of the apparatus 100), allows the user to mold the central shaft portion 110 to produce the desired angle $\beta$. Alternatively and/or additionally, a coupling mechanism between the central shaft portion 110 and the material-holding element 115 may be designed to allow adjustment of the angle $\beta$. Other possibilities exist as well.

In certain embodiments, this angle $\beta$ may fall within a range of between approximately 60 degrees and 180 degrees, or more particularly within a range of between 90 degrees and 145 degrees. In a particular aspect, the angle $\beta$ may be between approximately 110 and 125 degrees, or between approximately 116 and 120 degrees. In practice, larger values of $\beta$ will produce relatively low-trajectory flight, with relatively lower spin rates, while smaller values of $\beta$ will produce relatively high-trajectory flight, with relatively higher spin rates. Depending upon implementation-specific circumstances and preferences, this angle $\beta$ can be set to obtain an optimum trajectory and/or spin rate.

Alternatively and/or additionally, the material holding element 115 may include one or more features or devices to enhance the friction between one portion of the material-holding element 115 and the roll of material 120. Merely by way of example, as illustrated by FIG. 6, the material-holding element 115 may include a protrusion 615 located so as to apply additional friction to a desired portion of the material roll 120 at the time of release. One skilled in the art will appreciate, based on this example, that a variety of different types of features may be used in this way to enhance friction between a desired portion of the material holding element 115 and the material 120 in order to produce a desired type of spin.

Figure 7:
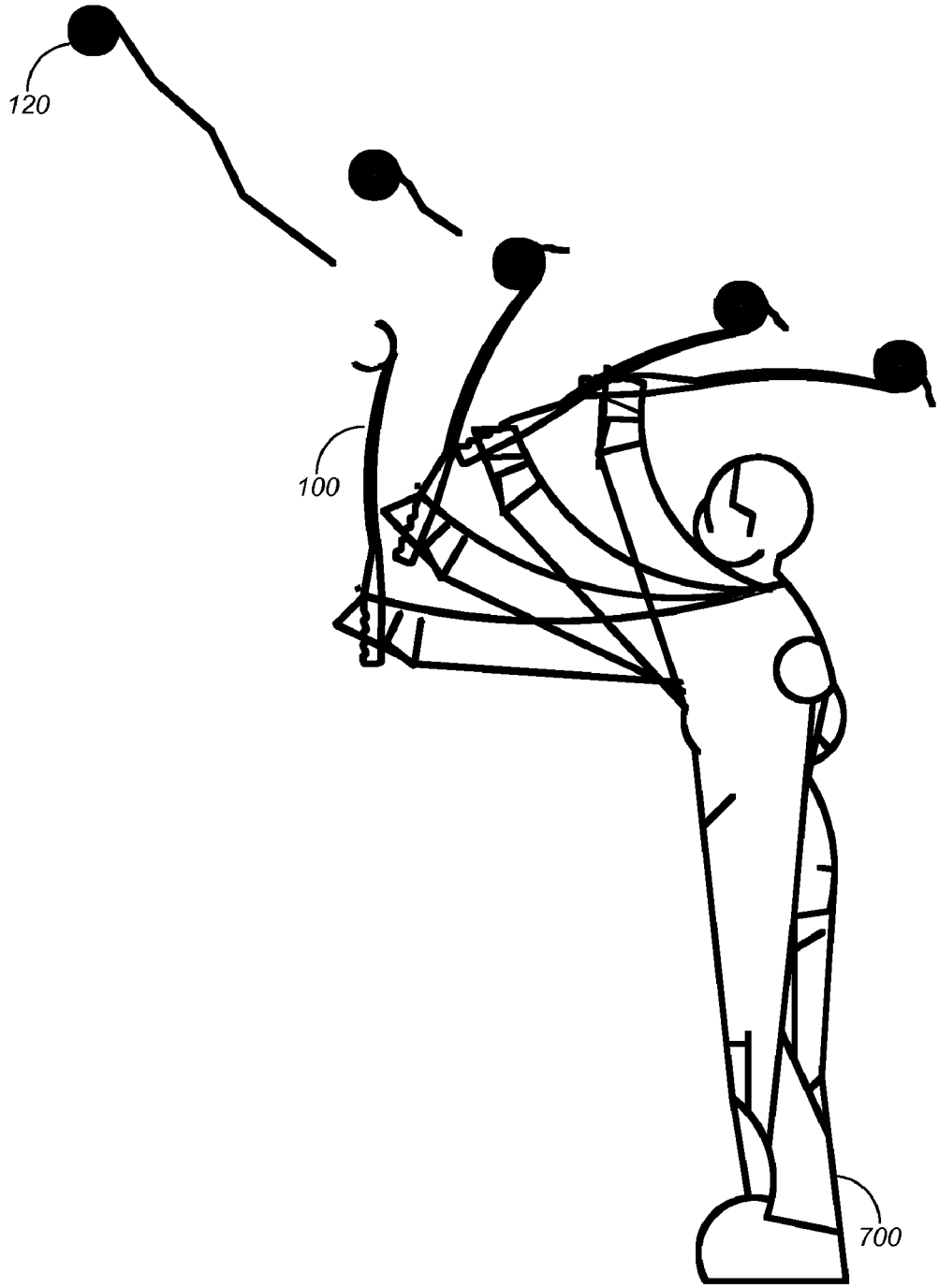
FIG. 7 illustrates an individual using a launching apparatus to throw a roll of paper, in accordance with various embodiments.

Another set of embodiments provides a method for throwing and/or launching a roll of paper or other material; in an aspect, such methods may employ the apparatus described herein. The method may cause the thrown material to unravel (unroll) while in the air, creating streamers of material. The method, in some embodiments, comprises situating a roll of material in a material-holding element of a launching apparatus (such as those described herein). In an aspect, the roll may be situated such that the longitudinal axis of the material is transverse to the longitudinal axis or plane of the launching apparatus, as depicted by FIG. 1. The method may further include holding a handle portion of the apparatus in one hand and/or quickly moving the apparatus in a motion generally describing an arc, perhaps with the central portion of the arc generally coinciding with the handle portion of the apparatus. This movement might be accomplished, for example, by an overhand or underhand throwing motion of a user 700, as illustrated by FIG. 7. The method further comprises stopping the motion of the apparatus (in some cases, relatively quickly), thereby allowing the angular momentum of the material to cause the material to separate from the apparatus, and thus launching the material into the air. In some cases, the movement of the apparatus is performed so as to cause the material to fly over a desired object. In certain cases, the method includes imparting differential friction on the roll of material to cause the roll to rotate about its longitudinal axis (as described above) as the roll separates from the apparatus, thereby causing the material to unroll as it travels through the air. Depending on the intended use, the method can further comprise moving the apparatus so as to release the material in a direction that will cause the material to drape over an object (such as a tree, car, rafter, etc.) as it unrolls. In this manner, the method can be used to apply decorative paper or other material as desired.

Apparatus and methods for launching and/or throwing material are described above. While various embodiments are described with—or without—certain features for ease of description and to illustrate exemplary aspects of those embodiments, the various components and/or features described herein with respect to a particular embodiment can be substituted, added and/or subtracted from among other described embodiments, unless the context dictates otherwise. Consequently, although several exemplary embodiments are described above, it will be appreciated that the invention is intended to cover all modifications and equivalents within the scope of the following claims.

What is claimed is:

1. An apparatus for launching or throwing a paper material, the paper material being arranged in a roll around a first longitudinal axis, the apparatus having a second longitudinal axis and comprising:

a handle portion;

a central shaft portion in mechanical communication with the handle portion; and a material-holding element in mechanical communication with the central shaft portion, the material-holding element being configured to engage the roll of paper material in order to hold the roll of paper material with the first longitudinal axis transverse to the second longitudinal axis and to release the roll of paper upon manipulation of the apparatus, such that the material-holding element imparts a spin upon the roll of paper material when releasing the roll of paper material, causing the roll of paper material to begin unroll upon release, wherein the material-holding element comprises a device to enhance friction between the material-holding element and the roll of paper material, in order to enhance a rate of spin of the roll of paper material.

2. The apparatus of claim 1, wherein the handle portion is mechanically coupled with the central shaft portion, and wherein the central shaft portion is mechanically coupled with the material-holding element.

3. The apparatus of claim 1, wherein the handle portion is bonded to the central shaft portion, and wherein the central shaft portion is bonded to the material-holding element.

4. The apparatus of claim 1, wherein the handle portion, the central shaft portion, and the material-holding element are integrally formed.

5. The apparatus of claim 1, wherein the apparatus has an overall length between approximately 12 inches and approximately 60 inches.

6. The apparatus of claim 1, wherein the apparatus has an overall length between approximately 30 inches and approximately 42 inches.

7. The apparatus of claim 1, wherein the material-holding element describes an open portion to allow the roll of paper material to be released, and wherein an angle β between the open portion and the second longitudinal axis of the apparatus is between approximately 60 degrees and 180 degrees.

8. The apparatus of claim 7, wherein the angle β between the open portion and the second longitudinal axis of the apparatus is between approximately 90 degrees and 145 degrees.

9. The apparatus of claim 7, wherein the angle β between the open portion and the second longitudinal axis of the apparatus is between approximately 110 and 125 degrees.

10. The apparatus of claim 7, wherein the angle β between the open portion and the second longitudinal axis of the apparatus is adjustable by a user of the apparatus.

11. A method of unrolling a rolled material, the method comprising:

engaging the rolled material with a launching apparatus, the launching apparatus comprising:

a handle portion;

a central shaft portion in mechanical communication with the handle portion; and a material-holding element in mechanical communication with the central shaft portion, the material-holding element being configured to engage the roll of paper material;

moving the apparatus through a range of motion describing an arc; and substantially stopping the movement of the apparatus to cause the apparatus to release the rolled material in such a way to impart a spin on the rolled material in order to cause the rolled material to begin to unroll upon release from the apparatus, wherein the material-holding element comprises a device to enhance friction between the material-holding element and the roll of paper material, in order to enhance a rate of spin of the roll of paper material.

12. The method of claim 11, wherein the rolled material is released in a direction to cause the material to drape over an object as it unrolls.

13. The method of claim 11, wherein the handle portion is mechanically coupled with the central shaft portion, and wherein the central shaft portion is mechanically coupled with the material-holding element.

14. The method of claim 11, wherein the handle portion, the central shaft portion, and the material-holding element are integrally formed.

15. The method of claim 11, wherein the apparatus has an overall length between approximately 12 inches and approximately 60 inches.

16. The method of claim 11, wherein the material-holding element describes an open portion to allow the roll of paper material to be released, and wherein an angle β between the open portion and the second longitudinal axis of the apparatus is between approximately 60 degrees and 180 degrees.

17. The method of claim 16, wherein the angle β between the open portion and the second longitudinal axis of the apparatus is adjustable by a user of the apparatus, and wherein the method further comprises adjusting the apparatus to modify the angle β.

18. An apparatus for launching or throwing a paper material, the paper material being arranged in a roll around a first longitudinal axis, the apparatus having a second longitudinal axis and comprising:

a handle portion;

a central shaft portion in mechanical communication with the handle portion; and a material-holding element in mechanical communication with the central shaft portion, the material-holding element being configured to engage the roll of paper material in order to hold the roll of paper material with the first longitudinal axis transverse to the second longitudinal axis and to release the roll of paper upon manipulation of the apparatus, such that the material-holding element imparts a spin upon the roll of paper material when releasing the roll of paper material, causing the roll of paper material to begin unroll upon release;

wherein the material-holding element describes an open portion to allow the roll of paper material to be released, and wherein an angle β between the open portion and the second longitudinal axis of the apparatus is adjustable by a user of the apparatus between approximately 60 degrees and 180 degrees.

19. The apparatus of claim 18, wherein the material-holding element comprises a device to enhance friction between the material-holding element and the roll of paper material, in order to enhance a rate of spin of the roll of paper material.

* * * * *